United States Patent [19]

Dose

[11] Patent Number: 4,666,119

[45] Date of Patent: May 19, 1987

[54] EXTENDIBLE FRAMEWORK

[76] Inventor: Raymond E. Dose, S.R. Box 86, Pinehurst, Id. 83850

[21] Appl. No.: 795,428

[22] Filed: Nov. 6, 1985

[51] Int. Cl.[4] ..... F16M 13/00

[52] U.S. Cl. ..... 248/421; 248/166; 297/56

[58] Field of Search ..... 248/421, 166, 157, 164, 248/431, 432, 168, 169, 439, 188.6, 439; 297/16, 56, 57, 422; 108/115, 118; 114/363

[56] References Cited

U.S. PATENT DOCUMENTS

| | | | |
|---|---|---|---|
| 136,167 | 2/1873 | Magoun | 297/56 |
| 156,709 | 11/1874 | Mellinger et al. . | |
| 1,203,572 | 11/1916 | Betts . | |
| 1,368,488 | 2/1921 | Crandall | 108/118 |
| 1,754,974 | 4/1930 | Warfield . | |
| 2,521,265 | 9/1950 | Starr . | |
| 2,557,594 | 6/1951 | Bryan | 108/118 |
| 2,649,140 | 8/1953 | Housel | 248/431 |
| 2,862,689 | 12/1958 | Dalrymple et al. . | |
| 3,062,603 | 11/1962 | Kamenstein | 108/118 X |
| 3,110,476 | 11/1963 | Farris . | |
| 3,147,040 | 9/1964 | Easterbrook . | |
| 3,646,895 | 3/1972 | Campbell . | |
| 3,718,365 | 2/1973 | Gibson . | |
| 3,789,444 | 2/1974 | McCord . | |
| 3,821,825 | 7/1974 | Bailey . | |
| 3,839,757 | 10/1974 | Grimes . | |
| 3,908,953 | 9/1975 | Miller | 248/421 |
| 4,122,571 | 10/1978 | Moeser . | |
| 4,433,869 | 2/1984 | Payne, Jr. et al. . | |

*Primary Examiner*—J. Franklin Foss

*Attorney, Agent, or Firm*—Wells, St. John & Roberts

[57] ABSTRACT

Extendible support frameworks having the ability to contract from an extended position into a collapsed position wherein the upper mounting plate is lowered and laterally displaced with respect to the lower mounting plate. The frameworks include at least one articulated leg having a first part and a second part joined by an articulation pivot. The first part of the articulated leg is pivotally connected to the upper mounting plate. The second part of the articulated leg is pivotally connected to the lower mounting plate. At least one or more swing arms are pivotally connected to the upper mounting plate at one end and pivotally connected to the lower mounting plate at the opposite end. An interconnection element extends from the swing arms so as to slidably engage with the first part of the articulated leg.

17 Claims, 7 Drawing Figures

EXTENDIBLE FRAMEWORK

FIELD OF THE INVENTION

This invention relates to extendible and collapsible support frames for a wide variety of applications, particularly for use with fishing boat seats and the like.

BACKGROUND OF THE INVENTION

It is desirable in fishing boats to have seats with backs to provide support to fishermen when they fish for an extended period of time. In relatively small fishing boats it is particularly advantageous to have seats which can be elevated so that fishermen can extend their legs rather than be seated low and be crowded to the floor of the boat. Elevated seats also provide better clearance over the sides of the boat and associated motors during fishing. Elevated seating further provides greater visibility.

It is undesirable to have elevated seating in relatively small fishing boats when running the boat at speeds above trolling speed, such as when going to and from fishing areas. Use of permanently elevated seating raises the overall center of gravity of the boat and makes it less stable. In addition, if seats with backs are mounted too close to the motor or other portions of the running gear of the boat, they may interfere with the proper operation thereof, particularly during relatively high speed operation. Permanent elevated seating may also obstruct easy loading and handling of small boats, such as when carried on top of a pickup or automobile.

It is accordingly desirable to have a fishing boat seat which can be in a relatively low configuration during launching and higher speed operation, and which can be moved to a relatively elevated position for fishing. It is also desirable to have such a fishing boat seat which can be displaced laterally to provide better access to the motor when being operated at higher speeds, and which can be more centrally located for use during fishing. These and other objectives and attributes of the invention will be described more fully hereinafter.

The prior art includes a fishing boat seat described in U.S. Pat. No. 3,839,757 to Grimes. In the Grimes patent the fishing seat support frame pivots upon four parallel links from an extended position to a retracted position. In the retracted position the seat is supported by a storage cabinet mounted in the boat.

An example of a chair having an adjustable seat is shown in U.S. Pat. No. 3,147,040 to Easterbrook. The Easterbrook patent discloses a folding frame requiring manipulation of various parts in order to adjust the chair from one height to another.

A further type of collapsible seat is disclosed in U.S. Pat. No. 2,521,265 to Starr. The Starr patent shows a relatively complex scissors action folding framework which allows only vertical motion of the seat.

U.S. Pat. No. 3,821,825 to Bailey discloses a further fishing seat structure which is adapted for adjustable positioning upon a transverse boat seat or thwart.

U.S. Pat. No. 3,789,444 to McCord shows a boat seat holder assembly which is designed to detachably and frictionally engage a boat thwart without requiring bolts or other mounting fasteners to be extended into the boat seat or other parts of the boat.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
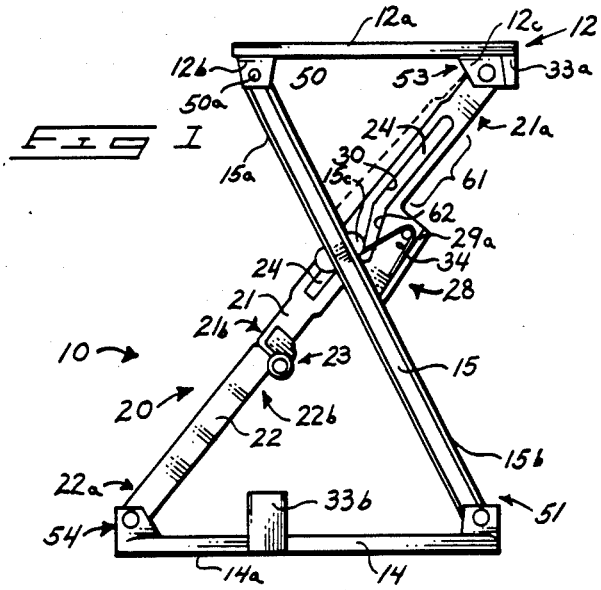
FIG. 1 is a front elevational view of a preferred embodiment extendible support framework according to this invention, the framework is shown in an extended position.

FIG. 1 shows a front view of a preferred extendible support framework 10 according to this invention. Support framework 10 includes a first or upper mounting member or plate 12 and a second or lower mounting member or plate 14. This descriptive terminology indicating the preferred orientation of the invention is not restrictive on the operability of the invention and the range of possible orientations in which framework 10 can be mounted and used. First and second mounting members 12 and 14 will accordingly often be referred to herein as upper and lower mounting plates 12 and 14 for increased clarity without derogating the breadth of the invention.

Upper mounting member 12 advantageously includes a first or upper mounting surface 12*a* across the upper surface of member 12. Similarly, second or lower mounting member 14 advantageously is formed to include a lower or second mounting surface 14*a*. Both mounting surfaces 12*a* and 14*a* are advantageously made planar so that extendible support framework 10 can easily be used and mounted to associated pieces of equipment which are provided with planar mounting surfaces. Other alternative mounting surface contours are also clearly possible.

Figure 6:
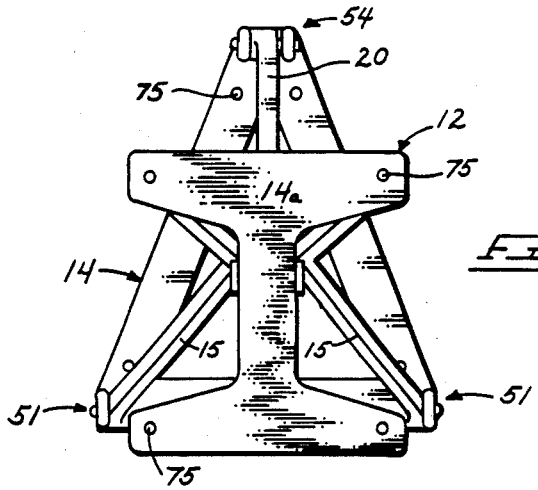
FIG. 6 is a top plan view of the support framework shown in FIG. 7.

FIG. 6 shows that upper mounting member 12 can advantageously be constructed in an I-shaped planar configuration. The specific planar shape of first or upper mounting member 12 is predominantly governed by pivots which will be discussed below, and the mounting requirements of the objects to which framework 10 is being mounted. The wide variety of possible mounting member shapes is further exemplified by the triangular shape of lower mounting member 14. Member 14 has a perimeter structure which extends between three general points and without internal structure in a hollow area enclosed therewithin.

Both upper and lower mounting plates 12 and 14 are advantageously provided with mounting holes 75 at a plurality of points to provide adequate means for mounting. Many alternative means for mounting will be readily obvious to those of ordinary skill in the art.

Figure 7:
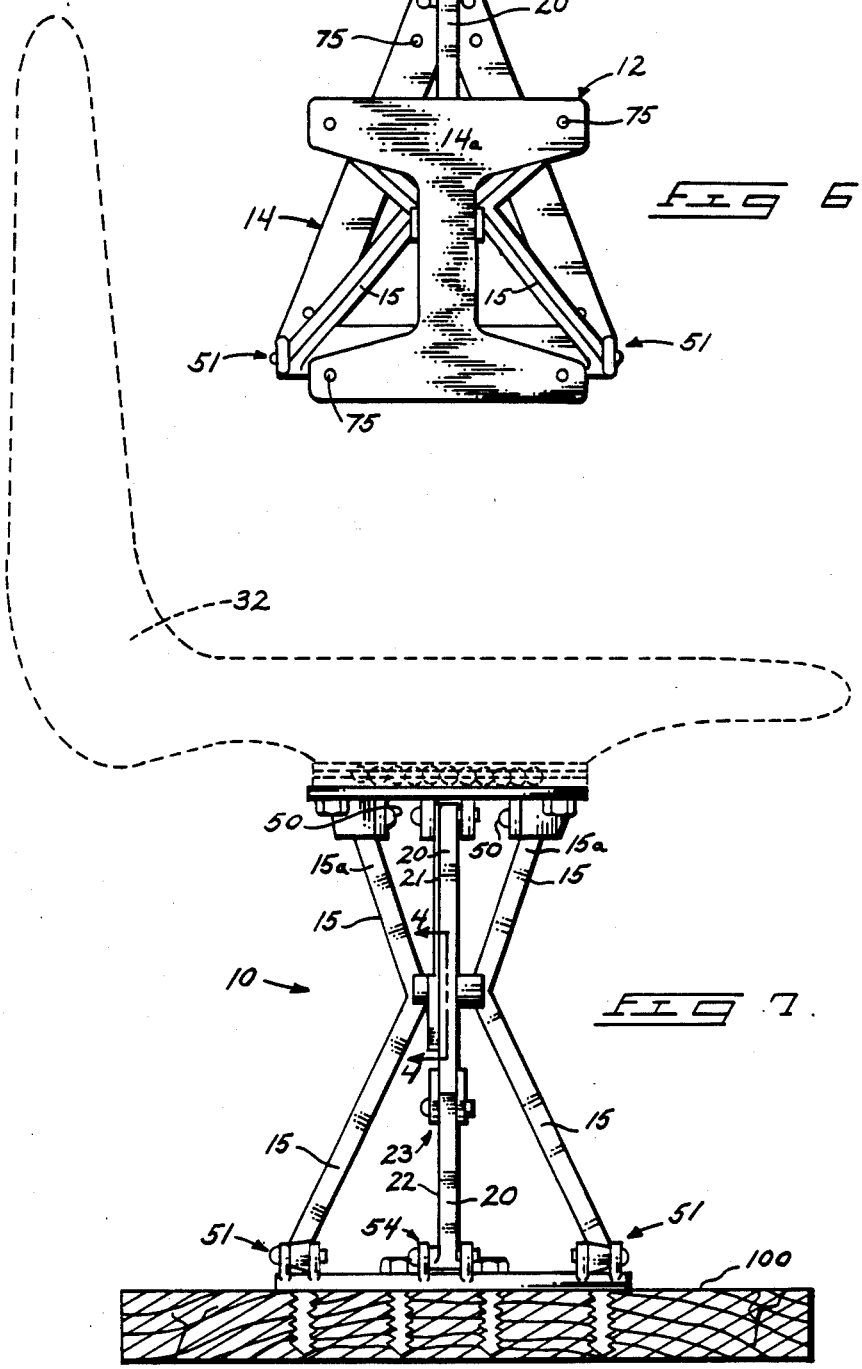
FIG. 7 is a side elevational view of the support framework shown in FIG. 1, with a possible swivel seating unit shown in phantom mounted thereto and with the framework mounted to a boat thwart in a preferred manner of use.

FIG. 7 shows framework 10 used in conjunction with a swivel seating unit 32 mounted to upper mounting plate 12. Lower mounting plate 14 is shown attached to a thwart or cross seat 100 typically used in row boats and relatively small fishing boats. It will be clear to those of ordinary skill in the art that many other alternative uses are possible for extendible support frameworks constructed according to this invention.

Framework 10 includes at least one swing arm member 15. The preferred embodiment shown in the Figs. advantageously includes two swing arm members 15. Single or greater numbers of swing arms are possible without departing from the teachings and principles of this invention.

Swing arm members 15 are preferably elongated and pivotally connected to the first and second mounting plates 12 and 14. First ends 15*a* of swing arms 15 are pivotally connected to upper mounting plate 12 at first swing arm pivots 50. Pivots 50 advantageously include extensions 12*b* on member 12 and pivot pins 50*a*.

Second or lower ends 15*b* of swing arm members 15 are similarly connected to lower mounting plate 14 at a second swing arm pivot 51. It will be apparent from FIGS. 1–3 and FIG. 7 that the two first swing arm pivots 50 are distinct as are both second swing arm pivots 51. However, these swing arm pivots are preferably aligned so that they share approximately the same pivotal axis.

Support framework 10 further includes an articulated leg member 20. Articulated leg member 20 is preferably elongated and comprises a first part 21 and a second part 22. First part 21 is pivotally connected to upper mounting plate 12 at its pivot end 21*a* to the upper mounting plate 12 using a first pivot 53. Second part 22 is pivotally connected at its pivot end 22*a* to lower mounting plate 14 using a second part pivot 54. First and second parts 21 and 22 are also pivotally joined at adjoining or articulated ends 21*b* and 22*b* using an articulation pivot 23.

Figure 4:
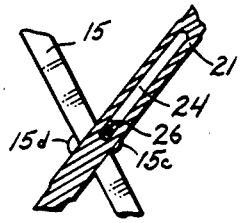
FIG. 4 is a partial cross-sectional view as taken along line 4—4 of FIG. 7.
Figure 5:
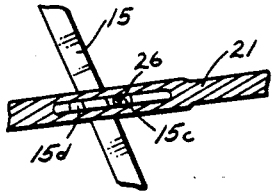
FIG. 5 is a partial cross-sectional view as taken along a line similar to line 4—4 with the parts oriented in accordance with the partially collapsed position shown in FIG. 2.

Articulated leg 20 is further provided with an interconnection slot 24 which extends transversely through first part 21. Interconnection slot 24 allows an interconnection element 26 (FIGS. 4 and 5) to extend therethrough. Interconnection element 26 is rigidly connected between and joins swing arm members 15. This is advantageously accomplished by mounting interconnecting element 26 between two bosses 15*c* formed at offset position from the central axis of swing arm members 15. Swing arm members 15 also are each advantageously provided with secondary bosses 15*d* opposite from bosses 15*c*. Both bosses 15*c* and 15*d* serve to reinforce member 15 at a crucial structural point.

Extendible support framework 10 further includes a suitable locking means such as locking means 28. The preferred locking means 28 advantageously includes a locking plate 29 which extends along leg 20 and is advantageously pivotally mounted at first part pivot 53. Locking plate 29 is provided with a flange 29*a* for easily applying force thereto to release the lock. Locking plate 29 is also provided with a specially shaped opening 30. Opening or aperture 30 is provided with a straight portion 61 (FIG. 1) which extends from the pivotal end fo locking plate 28 toward the distal end thereof. An offset section 62 angles obliquely away from the direction defined by straight section 61 and toward a biasing spring 34. A locking detent portion 31 (FIG. 2) forms the extreme end of opening 30. Locking detent 31 is advantageously formed so as to be at an approximately right angle to the direction defined by straight section 61.

Locking means 28 further includes a suitable biasing means such as hairpin spring 34. Hairpin spring 34 is advantageously wound once or twice about a mounting stub 38 formed along an outer side 29*a* of locking plate 29. Hairpin spring 34 or other alternative biasing means serve to bias locking plate 29 such that the plate is shifted downwardly and to the right as shown in FIG. 1 in order to engage the detent portion 31 of opening 30 over the interconnecting element 26 extending between swing arms 15. The exposed end 34a of spring 34 bears against element 26 or some other suitable part.

Figure 3:
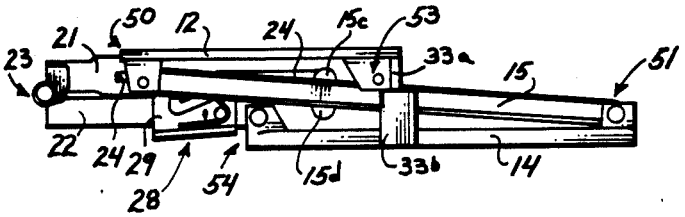
FIG. 3 is a front elevational view of the extendible support framework shown in FIGS. 1 and 2 in a fully collapsed position.

Extendible support framework 10 further advantageously includes a plurality of support lugs 33 mounted or integral with the upper and lower mounting plates 12 and 14. Upper lugs 33*a* are connected with upper mounting plate 12. Lower lugs 33*b* are connected to lower mounting plate 14. Upper and lower lugs 33*a* and 33*b* interengage at perpendicular angles in order to reduce the potential for misalignment as best illustrated in FIG. 3. Lugs 33 directly transfer forces applied to mounting plates 12 and 14 so that swing arms 15 and articulating leg 20 need not support the entire load when framework 10 is in the collapsed position.

The manner of using extendible support frameworks constructed according to this invention will now be described in the context of the preferred support framework 10. FIG. 1 shows framework 10 in a fully extended position. In this position the articulated leg 20 is placed in an aligned position so that first part 21 and second part 22 are aligned. Adjoining ends 21*b* and 22*b* are advantageously constructed so as to barely contact one another when leg 20 is in the aligned position. Any contact between adjoining ends 21*b* and 22*b* must not, however, be so excessive as to cause binding of articulation pivot 23 thereby placing undue stress on the hinge structure forming pivot 23.

FIG. 1 shows that locking means 28 is biased into a locking position when framework 10 is in the extended position. This biasing action is provided by the distal end 34*a* of spring 34 bearing upon interconnection element 26. Spring 34 forces locking plate 29 downwardly and places detent portion 31 over interconnecting element 26 thus preventing it from moving with respect to slot 24 formed through first part 21.

Figure 2:
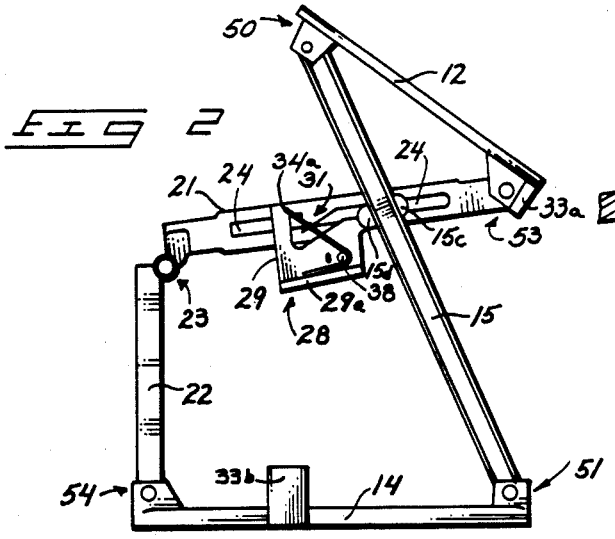
FIG. 2 is a front elevational view of the extendible support framework shown in FIG. 1 moved into a partially collapsed position.

Locking means 28 is released by pivoting locking plate 29 clockwise about pivot 53, or about some other suitable alternative pivot point from which plate 29 is mounted. FIG. 1 shows the top edge of locking plate 29 in a release position in phantom. In the release position, locking plate 29 is moved so that detent 31 clears interconnecting element 26 and is thereby freed to slide relative to the obliquely angled section 62 formed in locking plate opening 30, and slide relative to slot 24. Release of framework 10 allows articulated leg 20 to pivot about articulation pivot 23 thus causing first part 21 to pivot clockwise and second part 22 to pivot counterclockwise, as shown in FIG. 2. The articulation of leg 20 continues until the fully contracted or collapsed position shown in FIG. 3 is achieved.

Adjustment of framework 10 from the collapsed position of FIG. 3 to the extended position of FIG. 1 is accomplished by merely moving the first or upper plate 12 away from the lower plate 14. When the articulated leg 20 is fully extended, the locking mechanism 28 locks the framework in the extended position of FIG. 1.

FIGS. 1–3 clearly demonstrate that upper mounting plate 12 is approximately parallel with respect to lower mounting plate 14 when unit 10 is in the extended position. The intermediate position displayed in FIG. 2 illustrates that the upper mounting plate 12 tilts with respect to the lower mounting plate 14 during the process of collapsing the support framework from the extended position to the collapsed position. FIG. 3 demonstrates that the upper mounting plate 12 and lower mounting plate 14 again resume a substantially parallel relationship when in the collapsed position. This dual parallel positioning allows a seating unit such as 32 to be comfortably used when the framework is in either the extended or collapsed position.

FIGS. 1–3 also demonstrate that the relative lateral position of upper and lower mounting plates 12 and 14 changes as a result of movement between the extended and collapsed positions. In the extended position the upper mounting plate 12 is slightly right of a center position above lower mounting plate 14. FIG. 3 shows that in the collapsed position upper mounting plate 12 has assumed a position substantially offset to the left. This collapsing and lateral offset motion allows the support framework to advantageously both lower and laterally displace the seating unit or other part which is mounted thereon. When support frameworks according to this invention are used as a fishing seat extension, this inherent motion allows the extended seat to be positioned relatively centered and upwardly during times of still fishing or relatively slow trolling. During times of relatively fast motion, the seat is offset to one side thereby giving greater clearance for the boat operator to control the typical small outboard motor.

EXAMPLE

The specific geometry used in one preferred support framework 10 according to this invention is as follows. The overall distance between pivots 50 and 51 of the swing arm members is approximately 10 inches (254 mm). The distance from pviot 50 to interconnecting piece 26 is approximately 4 inches (102 mm). The slot 24 is approximately 3½ inches long (90 mm). The first part 21 and second part 22 are approximately 7 inches (128 mm) and 4½ inches (114 mm), respectively, between associated pivots. The horizontal spacing between pivots 50 and 53 is approximately 5 inches (127 mm), and between pivots 51 and 54 is approximately 7¼ inches (184 mm). These specifications are given merely to illustrate the relative proportions of the elements used in a preferred size of framework 10.

It will be apparent to those skilled in the art that extendible support frameworks according to this invention can be constructed of a wide variety of materials in conformance with the functional and structural relationship taught herein. A preferred material of construction is die cast zinc alloy for the main structural components.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An extendible support framework adjustable between a collapsed position and an extended position, comprising:

a first mounting member;

a second mounting member;

at least one elongated swing arm member extending between and connected to said first and second mounting members; said swing arm member being pivotally connected to the first mounting member at a first swing arm pivot pivotable about a first swing arm axis which is fixed relative to the first mounting member; said swing arm member also being pivotally connected to the second mounting member at a second swing arm pivot pivotable about a second swing arm axis which is fixed relative to said second mounting member;

at least one elongated articulated leg member having a first part and a second part pivotally joined together at an articulation pivot; said first part being pivotally connected to the first mounting member at a first part pivot pivotable about a first part pivot axis which is fixed relative to said first mounting member and said first swing arm axis; said second part being pivotally connected to the second mounting member at a second part pivot pivotable about a second part pivot axis which is fixed relative to said second mounting member and said second swing arm axis;

said swing arm member and said articulated leg member being arranged to cross and interconnect along intermediate portions thereof at an interconnection means; said interconnection means being rigidly connected to said swing arm member and slidably engaging said articulated leg member;

whereby the first and second mounting members can be spaced further apart when moved from the collapsed position to the extended position while maintaining approximately the same relative angular orientation between said first and second mounting members

2. The extendible support framework of claim 1 further comprising locking means for detachably locking the support framework in the extended position.

3. The extendible support framework of claim 1 further comprising locking means for detachably locking against relative motion between the interconnection element and the articulated leg member.

4. The extendible support framework of claim 2 wherein said locking means comprises a locking plate pivotally connected to said articulated leg member.

5. The extendible support framework of claim 1 wherein the articulation pivot is offset from adjoining portions of said first and second parts of the articulated leg member.

6. The extendible support framework of claim 1 wherein there is a single articulated leg member arranged between a plurality of swing arm members.

7. The extendible support framework of claim 6 wherein the interconnection means is an element connected between at least two swing arm members.

8. The extendible suppport framework of claim 7 wherein the interconnection element is slidably received within an interconnection slot formed in the first part of the articulated leg member.

9. The extendible support framework of claim 1 wherein all articulated leg members have first part pivots and second part pivots which pivot about a common first part pivot axis and a common second part pivot axis, respectively.

10. The extendible framework of claim 1 wherein all swing arm members have first swing arm pivots which pivot about a first common pivot axis, and have second swing arm pivots which pivot about a second common pivot axis.

11. The extendible support framework of claim 1 further comprising support lugs rigidly attached to said first and second mounting members for interengagements when the support framework is in the collapsed position to thereby transfer supported weight directly therebetween.

12. The extendible support framework of claim 1 wherein said first part of the articulated leg member is longer than said second part.

13. The extendible support framework of claim 1 wherein said swing arm member and said articulated leg member are arranged and constructed so as to cross when the framework is in the extended position.

14. The extendible support framework of claim 1 wherein the first and second mounting members are provided with opposed mounting surfaces which are approximately parallel when the framework is in both the extended and collapsed positions.

15. The extendible support framework of claim 1 further comprising a seating unit rigidly connected to a mounting member.

16. The extendible support framework of claim 15 further comprising means for mounting said framework to said seating unit and to some supporting member.

17. An extendible support framework for use in adjustably mounting seating to a thwart of a boat, the framework being movable between a collapsed position wherein any attached seating is positioned relatively low and laterally displaced to one side, and an extended position wherein such seating is positioned relatively higher and centrally without substantial lateral displacement and in approximately the same relative angular orientation as in the collapsed position; comprising:

a first mounting member having a mounting surface, and being adapted for rigid connection to either the thwart of the boat or the seating;

a second mounting member having a mounting surface, and being adapted for rigid connection to either the thwart of the boat or the seating;

at least one elongated swing arm member extending between and connected to said first and second mounting members; said swing arm member being pivotally connected to the first mounting member at a first swing arm pivot pivotable about a first swing arm axis which is fixed relative to the first mounting member; said swing arm member also being pivotally connected to the second mounting member at a second swing arm pivot pivotable about a second swing arm axis which is fixed relative to said second mounting member;

at least one elongated articulated leg member having a first part and a second part pivotally joined together at adjoining ends by an articulation pivot; said first part being pivotally connected at a distal end thereof to the first mounting member by a first part pivot pivotable about a first part pivot axis which is fixed relative to said first mounting member and said first swing arm axis; said second part being pivotally connected at a distal end thereof to the second mounting member by a second part pivot pivotable about a second part pivot axis which is fixed relative to said second mounting member and said second swing arm axis; said first part including a slot means extending transversely therethrough;

an interconnection element rigidly spanning between at least two swing arm members at intermediate portions thereof providing structural support therebetween; said interconnection element further extending through said slot means to interconnect with said articulated member in slidable engagement therewith; and locking means for detachably securing the framework in the extended position.

* * * * *